US006484445B2

(12) United States Patent
Chang

(10) Patent No.: US 6,484,445 B2
(45) Date of Patent: Nov. 26, 2002

(54) SLIDE WINDOW AND DOOR LOCK

(76) Inventor: Marshall Chang, 7019 Pomelo Dr., Westhills, CA (US) 91307

( * ) Notice: Subject to any disclaimer, the term of this patent is extended or adjusted under 35 U.S.C. 154(b) by 136 days.

(21) Appl. No.: 09/829,460

(22) Filed: Apr. 9, 2001

(65) Prior Publication Data

US 2002/0144465 A1 Oct. 10, 2002

(51) Int. Cl.[7] ..... E05F 1/00

(52) U.S. Cl. ..... 49/451; 292/339; 292/289; 292/DIG. 16

(58) Field of Search ..... 49/449, 450, 451; 292/339, 338, 288, 289, 297, 342, 343, DIG. 15, DIG. 16

(56) References Cited

U.S. PATENT DOCUMENTS 2,254,167 A * 8/1941 Carpenter ..... 292/338
2,768,850 A * 10/1956 Minnis ..... 292/338
2,774,622 A * 12/1956 Priebe ..... 292/339
4,407,539 A * 10/1983 Asp ..... 292/DIG. 46
4,657,293 A * 4/1987 Bell ..... 292/339

* cited by examiner

*Primary Examiner*—Jerry Redman
(74) *Attorney, Agent, or Firm*—Raymond Y. Chan; David and Raymond Patent Group

(57) ABSTRACT

A slide window and door lock includes a connecting device selectively mounted on a vertical jamb of a sliding panel at a predetermined height with respect to a base slider track of a supporting frame and a locker panel having one pivot edge pivotally connecting to the connecting device and another opposed locking edge adapted for inclinedly biasing against the base slider track at a predetermined angle so as to lock up the sliding panel in a slidably movable manner.

16 Claims, 7 Drawing Sheets

SLIDE WINDOW AND DOOR LOCK

BACKGROUND OF THE PRESENT INVENTION

1. Field of Invention

The present invention relates to a sliding side window and door, and more particularly to a side window and door lock which is adapted for selectively locking the side window and door at a predetermined opened position, so as to prevent the side window and door from being slidably opened unintentionally.

2. Description of Related Arts

Referring to FIG. 1A, a conventional sliding door/window assembly 1 comprises a door/window frame 10 for supporting the door/window thereon wherein the door/window frame 10, having a sliding panel 12 and a fixed panel 11, is supporting on the supporting frame 20 in such a manner that the sliding panel 12 of the door/window frame 10 is slidably mounted on a base slider track 21 of a supporting frame 20 in such a manner that the sliding panel 12 is vertically and reciprocally sliding along the base slider track 21 of the supporting frame 20 to open and close the door/window assembly 1.

Generally, the conventional door/window assembly 1 further comprises a lock mechanism for locking the sliding panel 12 on the supporting frame 20 at a fully closed position. As shown in FIGS. 1B through 1D, the lock mechanism varies from use of a pin that penetrates through the sliding panel 12 and the fixed panel 11, a hook that hooks the sliding panel 12 to the supporting frame 20 at fully closed position, or by clamping a locker on the base slider track 21 of the supporting frame 20 so as to block the sliding panel 12 from being slid aside. One problem with the existing lock mechanisms is that the lock mechanisms can only lock up the sliding panel 12 at the fully closed position. 1f one wants to lock the door or window at an opened position, the lock is rendered useless. Although an adjustable lock that is detachably mounted at the base slider track 21 of the supporting frame 20 can solve the above mentioned problem, however, the current adjustable lock requires constant attaching and detaching in order for one to change the opening position of the door/window assembly 1.

As shown in FIG. 1E, an improved lock mechanism comprises a handle hinge rotatably mounted on a vertical jamb 121 of the sliding panel 12 and a locking arm extended sidewardly for biasing against the fixed panel 11 wherein the handle hinge is arranged to move the locking arm from a locking position, i.e. the locking arm is biased against the fixed panel 11, to an unlocked position, i.e. the locking arm is moved away from the fixed panel 11, so as to selectively lock up the sliding panel at a predetermined opened position. However, the original structure of the door/window assembly must be altered its original structure in order to install the lock mechanism thereinto, which will increase the manufacturing cost and installation fee of the door/window assembly.

SUMMARY OF THE PRESENT INVENTION

A main object of the present invention is to provide a slide door and window lock which is adapted for securely locking a slide door/window in a slidably movable manner, so as to prevent the slide door/window from being slidably opened.

Another object of the present invention is to provide a slide door and window lock which is adapted for selectively locking the slide door/window at a predetermined opened position.

Another object of the present invention is to provide a slide door and window lock which can be fitted for an existing slide door/window without altering its original structural design so as to minimize the cost of manufacturing cost of the slide door/window having a vertical jamb.

Accordingly, in order to accomplish the above objects, the present invention provides a slide window and door lock for window/door assembly which comprises a sliding panel, having a vertical jamb, slidably mounted on a base slider track, wherein the slide window/door lock comprises:

a connecting device selectively mounted on the vertical jamb at a predetermined height with respect to the base slider track; and a locker panel having one pivot edge pivotally connecting to the connecting device and another opposed locking edge selectively moved between a locked position and an unlocked position, wherein in the locked position, the locking edge of the locker panel is inclinedly biased against the base slider track at a predetermined angle so as to lock up the sliding panel in a slidably movable manner and in the unlocked position, the locking edge of the locker panel is moved away from the base slider track such that the sliding panel is capably of freely sliding along the base slider track.

DETAILED DESCRIPTION OF THE EMBODIMENT

Figure 1A:
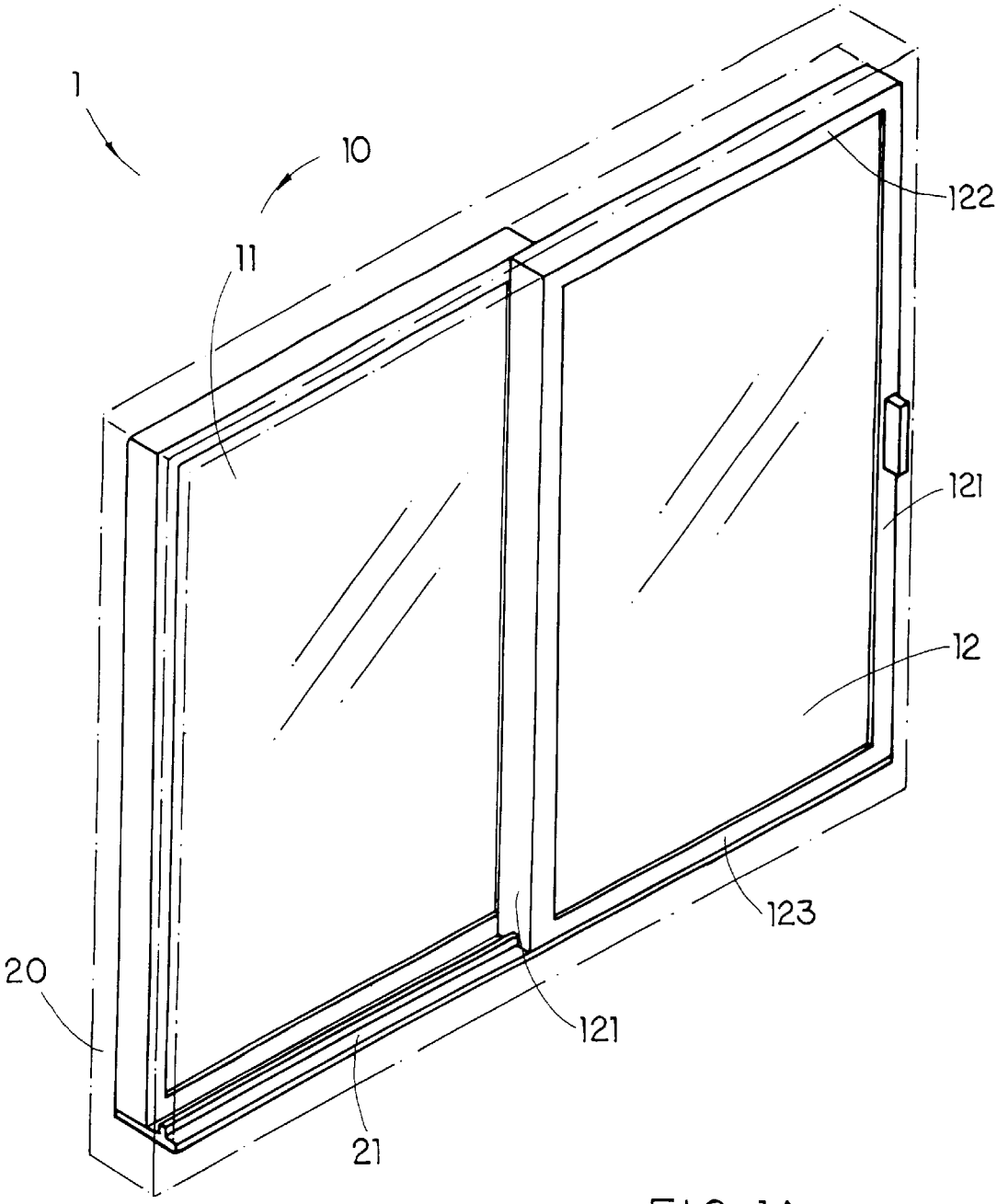
FIG. 1A is a perspective view of a conventional slide window and door.
Figure 1C:
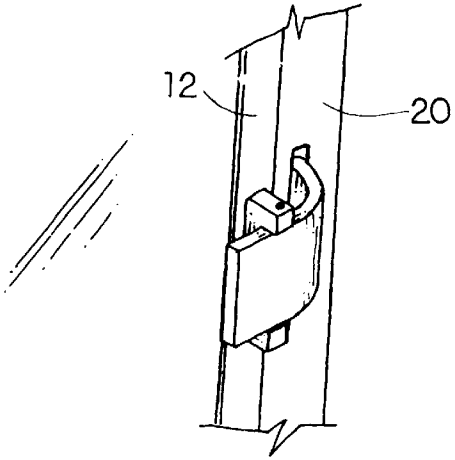
FIG. 1C is a perspective view of a conventional hook lock for the slide window and door.
Figure 1E:
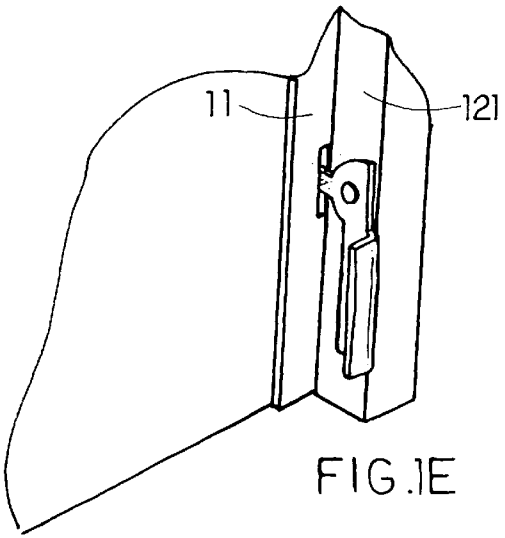
FIG. 1E is a perspective view of a conventional handle hinge for the slide window and door.
Figure 1B:
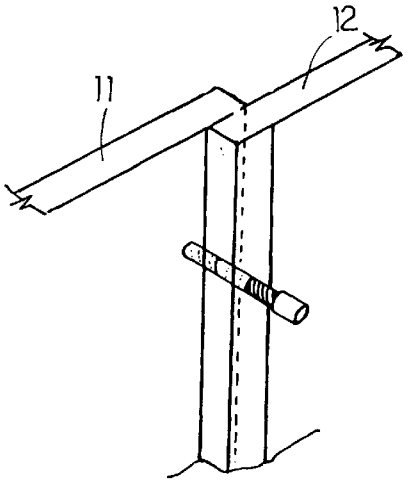
FIG. 1B is a perspective view of a conventional pin lock for the slide window and door.
Figure 1D:
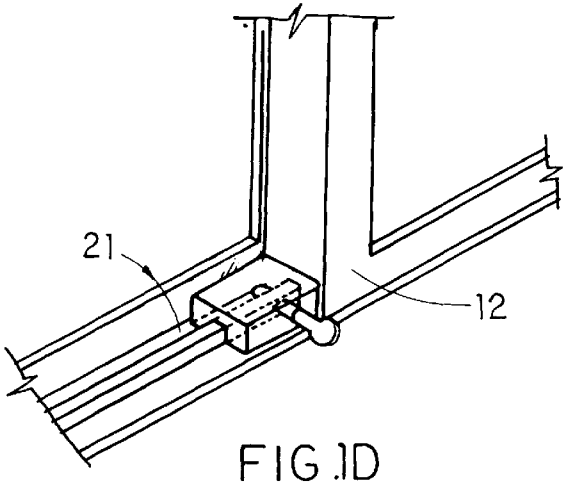
FIG. 1D is a perspective view of a conventional clamp lock for the slide window and door.
Figure 2:
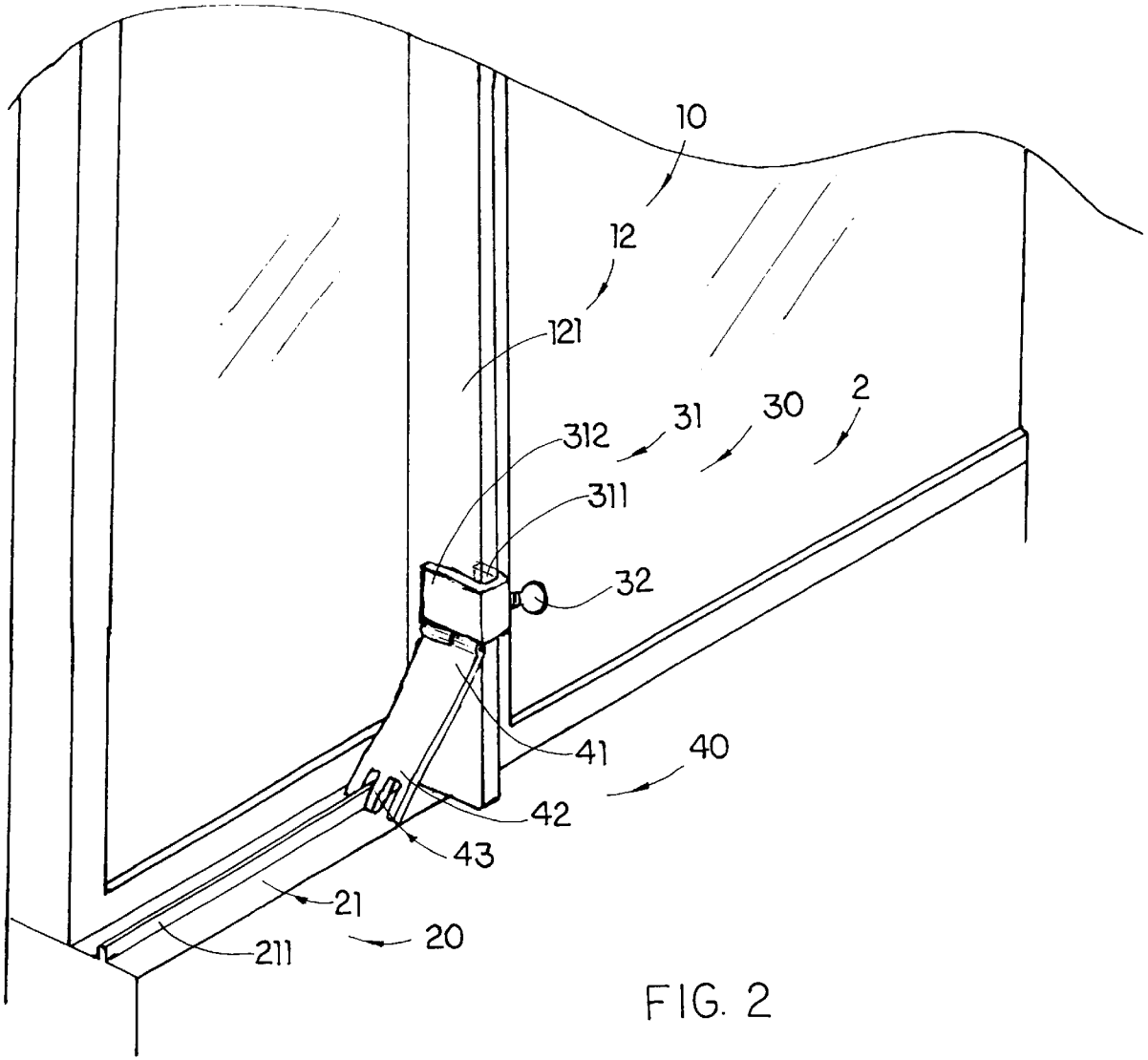
FIG. 2 is a perspective view of a slide window and door lock according to a first preferred embodiment of the present invention.

Referring to FIG. 2 of the drawings, a slide window and door lock 2 according to a preferred embodiment of the present invention is illustrated, wherein the slide window and door lock 2 is adapted for incorporating with an existing slide window/door assembly 1, as mentioned in the background which comprises a window/door frame 10 for supporting a window/door thereon wherein the window/door frame 10, which comprises a fixed panel 11 and a sliding panel 12, is supported on a supporting frame 20. The sliding panel 12 of the window/door frame 10 generally having a rectangular shaped comprises a pair of parallel vertical jambs 121, a top rack 122, and a bottom rack 123 wherein the sliding panel 12 is adapted for sliding on a base slider track 21 of the supporting frame 20 so as to slidably open and close the slide window/door assembly 1, as shown in FIG. 1A.

The slide window and door lock 2 comprises a connecting device 30 selectively mounted on the vertical jamb 121 at a predetermined height with respect to the base slider track 21, and a locker panel 40 having one pivot edge 41 pivotally connecting to the connecting device 30 and another opposed locking edge 42 selectively moved between a locked position and an unlocked position. In which, in the locked position as shown in FIG. 3, the locking edge 42 of the locker panel 40 is inclinedly biased against the base slider track 21 at a predetermined angle so as to lock up the sliding panel 12 in a slidably movable manner and in the unlocked position as shown in FIG. 4, the locking edge 42 of the locker panel 40 is moved away from the base slider track 21 such that the sliding panel 12 is capably of freely sliding along the base slider track 21.

According to the preferred embodiment, the connecting device 30 comprises a U-shaped connecting member 31 comprising a first and second connecting walls 311, 312 extended integrally for receiving the vertical jamb 121 therebetween, and an adjustable screw 32 rotatably penetrated through the first connecting wall 311 wherein a head portion of the adjustable screw 32 is arranged to adjustably bias against the jamb 121 of the sliding panel 12 at a side thereof when the connecting member 31 is mounted on the sliding panel 12, so as to securely mount the connecting device 30 on the vertical jamb 121 of the sliding panel 12.

Figure 4:
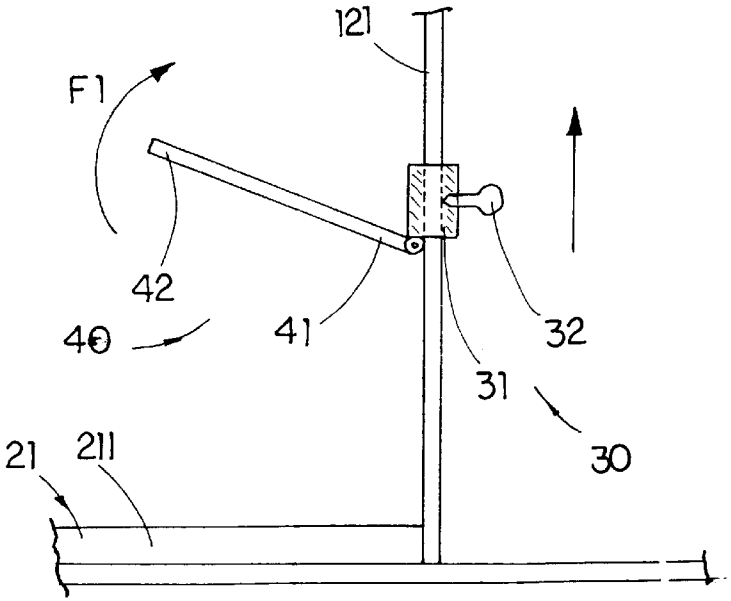
FIG. 4 is a side view of the slide window and door lock in an unlocked position according to the above first preferred embodiment of the present invention.
Figure 3:
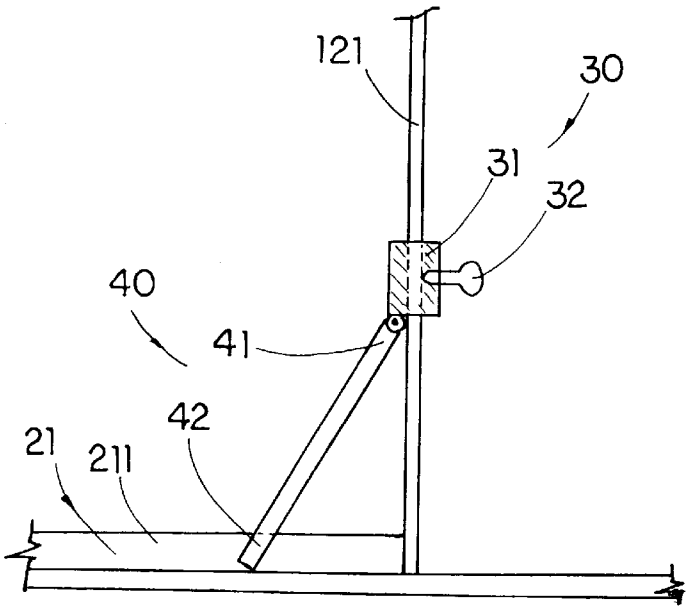
FIG. 3 is a side view of the slide window and door lock in a locked position according to the above first preferred embodiment of the present invention.

The pivot edge 41 of the locker panel 40 is pivotally connected to the second connecting wall 312 of the connecting member 31 of the connecting device 30 edge to edge in such a manner that the locking edge 42 of the locker panel 40 is adapted for pivotally folding from the locked position, as shown in FIG. 3, to the unlocked position, as shown in FIG. 4.

Accordingly, the connecting device 30 is adjustably mounted on the vertical jamb 121 at the predetermined height with respect to the base slider track 21, which is less than a length of the locker panel 40 in such a manner that the locker panel 40 is adapted for inclinedly biasing against the base slider track 21 at the locking edge 41 in the locked position.

It is worth to mention that the locker panel 40 is inclinedly laid on the base slider track 21 at the predetermined angle. As the sliding panel 12 is being pushed towards the open position, a resulting downward force is transmitted along the locker panel 40. As a result, an opposite resulting force occurs at where the locking edge 42 of the locker panel 40 is in contact with the base slider track 21, so as to prevent the sliding panel 12 from being opened. If the locker panel 40 is laid completely flat with the base slider track 21, no resulting force can be generated when the sliding panel 12 is being pushed open. The optimum angle of the locker panel 40 with respect to the base slider track 21 is 45 degrees for providing the maximum resulting force of the locker panel 40 to bias against the sliding panel 12.

For increasing the mutual friction between the locker panel 40 and the base slider track 21, the locking edge 42 of the locker panel 40 has a rough edge surface wherein the rough edge surface 42 of the locker panel 40 is adapted for increasing the opposite resulting force of the locker panel 40 to bias against the sliding panel 12 when the sliding panel 12 is being pushed open.

The locker panel 40 further comprises at least a guiding groove 43 longitudinally extended from the locking edge 41 of the locker panel 40 wherein the guiding groove 43 of the locker panel 40 is adapted for fitting in a guide wall 211 of the base slider track 21 so as to fit for the base slider track 21 having a guide wall 211 upwardly extended therefrom. For guiding the guide wall 211 of base slider track 21 fitted into the guiding groove 43 of the locker panel 40, the connecting member 31 is adapted for adjustably mounting on the vertical jamb 121 of the sliding panel 12 with a predetermined width. In other words, the slide window and door lock 2 of the present invention fits for all window/door assemblies 1with different widths of the base slider track 21.

For unlocking the slide window and door lock 2, the lifting rotational force F1 must be intentionally applied on the locker panel 40 in order to pivotally move the locking edge 42 of the locker panel 40 away from the base slider track 21 so as to temporary unlock the sliding panel 12. Once the lifting rotational force is released, due to the gravity, the locker panel 40 will automatically drop down so that the locking edge 42 of the locker panel 40 will be biased against the base slider track 21 to re-lock the sliding panel 12. It is worth to mention that when the connecting device 30 is lifted up on the vertical jamb 121, the locker panel 40 is suspendedly supported on the vertical jamb 121 of the sliding panel 12 in such a manner that the locking edge 42 of the locker panel 40 will be permanently disengaged with the base slide track 21. So, the two unlocking operations as mentioned above can fit for the need of a user.

Figure 5:
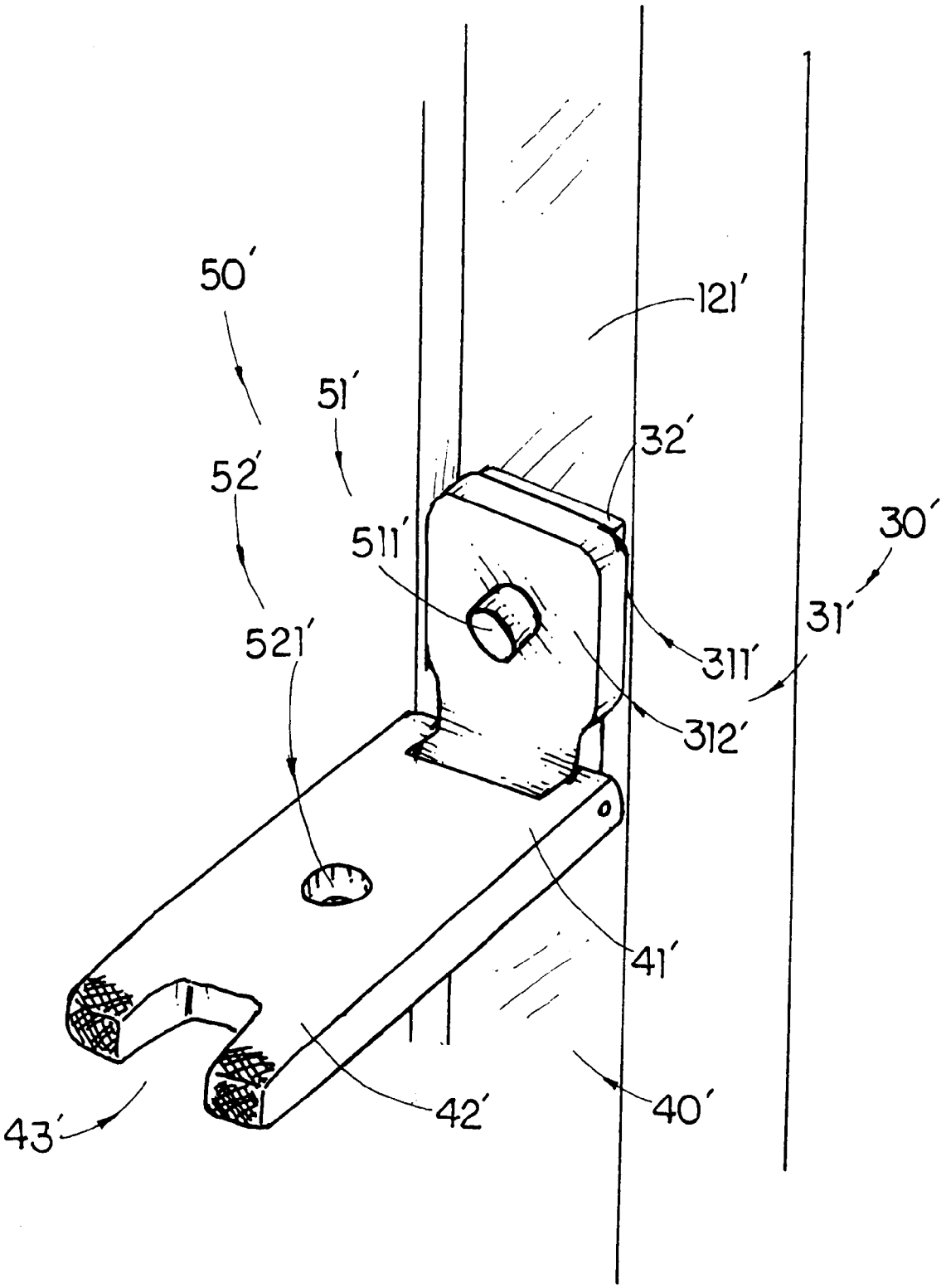
FIG. 5 is a perspective view of a slide window and door lock according to a second preferred embodiment of the present invention.

Referring to FIG. 5, a second embodiment of the present invention illustrates an alternative mode of the above first embodiment. According to the second embodiment, the connecting device 30' comprises a connecting panel 31' affixedly attached on the vertical jamb 121' at a rear surface 311' thereof wherein the pivot edge 41' of the locker panel 40' is pivotal connecting to the connecting panel 31' edge to edge. Accordingly, a glue pad 32' is provided on the rear surface 311' of the connecting panel 31' in such a manner that the connecting panel 31' is adhesively attached on the vertical jamb 121' of the sliding panel 12'.

For increasing the mutual friction between the locker panel 40' and the base slider track 21' , the locking edge 42' of the locker panel 40' has a rough edge surface wherein the rough edge surface 42' of the locker panel 40' is adapted for increasing the opposite resulting force of the locker panel 40' to bias against the sliding panel 12' when the sliding panel 12' is being pushed open.

The locker panel 40' further comprises at least a guiding groove 43' longitudinally extended from the locking edge 41' of the locker panel 40' wherein the guiding groove 43' of the locker panel 40' is adapted for fitting in a guide wall 211' of the base slider track 21' so as to fit for the base slider track 21' having a guide wall 211' upwardly extended therefrom.

The slide window and door lock 2' further comprises a holding means 50' for holding the locker panel 40' in the unlocked position wherein the holding means 50' comprises at least a first holding member 51' provided on a front surface 312' of the connecting panel 31' and at least a second holding member 52' provided on a corresponding surface of the locker panel 40' in such a manner that the locker panel 40' is pivotally mounted on the connecting panel 31' by detachably attaching the second holding member 52' to the first holding member 51'.

Accordingly, the first holding member 51' is a protrusion 511' outwardly extended from the front surface 312' of the connecting panel 31' and the second holding member 52' is a holding slot 521' having a size and shape corresponding to the protrusion 511' and adapted for the protrusion 511' fittedly inserting into the holding slot 521', so as to hold the locker panel 40' in the unlocked position.

Figure 6:
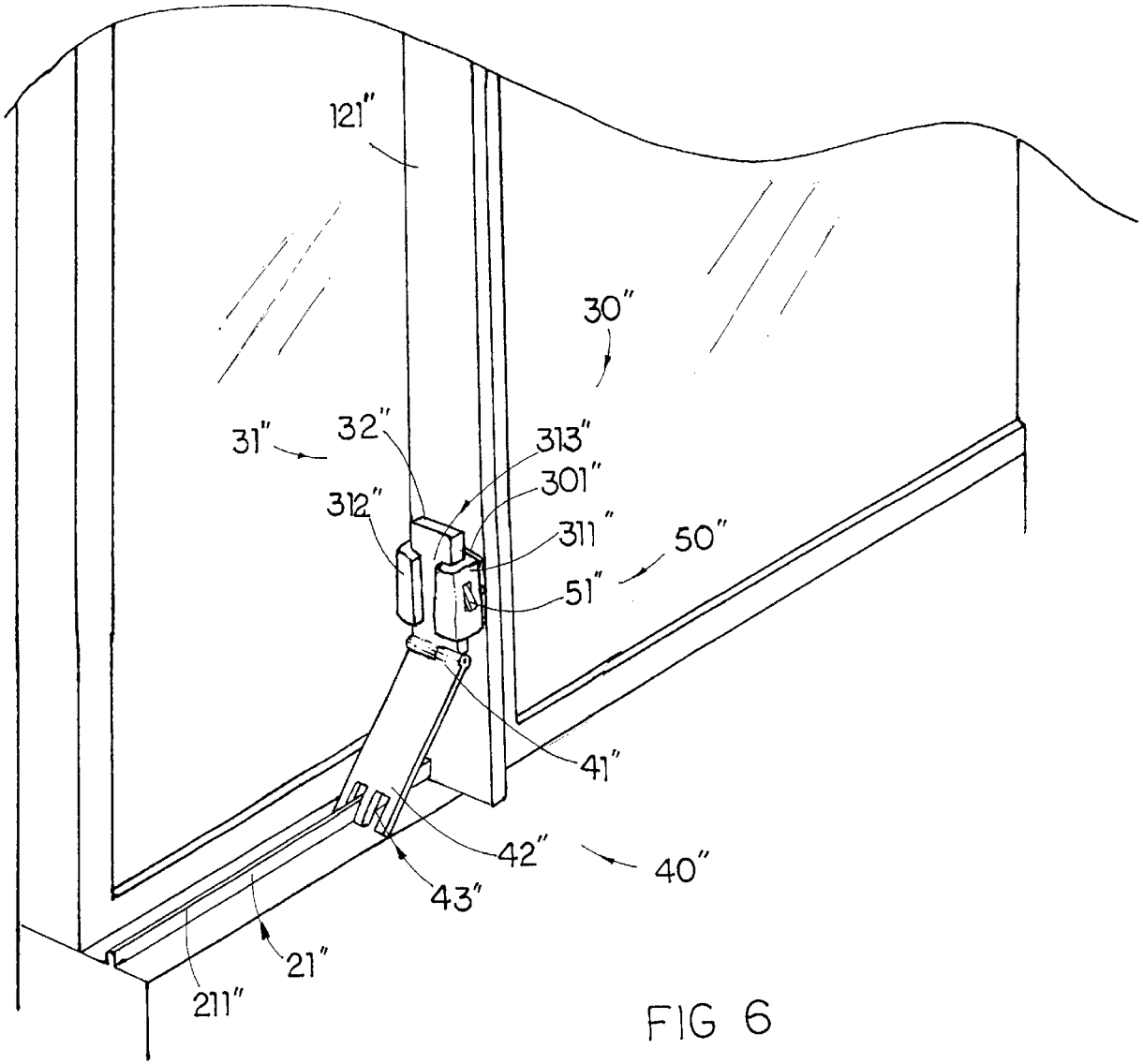
FIG. 6 is a perspective view of a slide window and door lock according to a third preferred embodiment of the present invention.

Referring to FIG. 6, a third embodiment of the present invention illustrates an alternative mode of the above second embodiment. The connecting device 30" comprises a connecting member 31" having a U-shaped cross section attached on the vertical jamb 121" by a glue pad 301". The connecting member 31" comprises a pair of connecting walls 311", 312" wherein a guiding slot 313" is defined between the two connecting walls 311", 312", and a driving panel 32" slidably mounted on the guiding slot 313" in a vertical movable manner.

The pivot edge 41" of the locker panel 40" is pivotally connected to the driving panel 32" edge to edge and is arranged to be driven to slide on the guiding slot 313" by the driving panel 32" in a vertical movable manner. The driving panel 32" has a width at least equal to a width of the locker panel 40" in such a manner that the locker panel 40" is adapted for fittedly sliding on the guiding slot 311" of the connecting member 31".

For increasing the mutual friction between the locker panel 40" and the base slider track 21", the locking edge 42" of the locker panel 40" has a rough edge surface wherein the rough edge surface 42" of the locker panel 40" is adapted for increasing the opposite resulting force of the locker panel 40" to bias against the sliding panel 12" when the sliding panel 12" is being pushed open.

The locker panel 40" further comprises at least a guiding groove 43" longitudinally extended from the locking edge 41" of the locker panel 40" wherein the guiding groove 43" of the locker panel 40" is adapted for fitting in a guide wall 211" of the base slider track 21" so as to fit for the base slider track 21" having a guide wall 211" upwardly extended therefrom.

Figure 7:
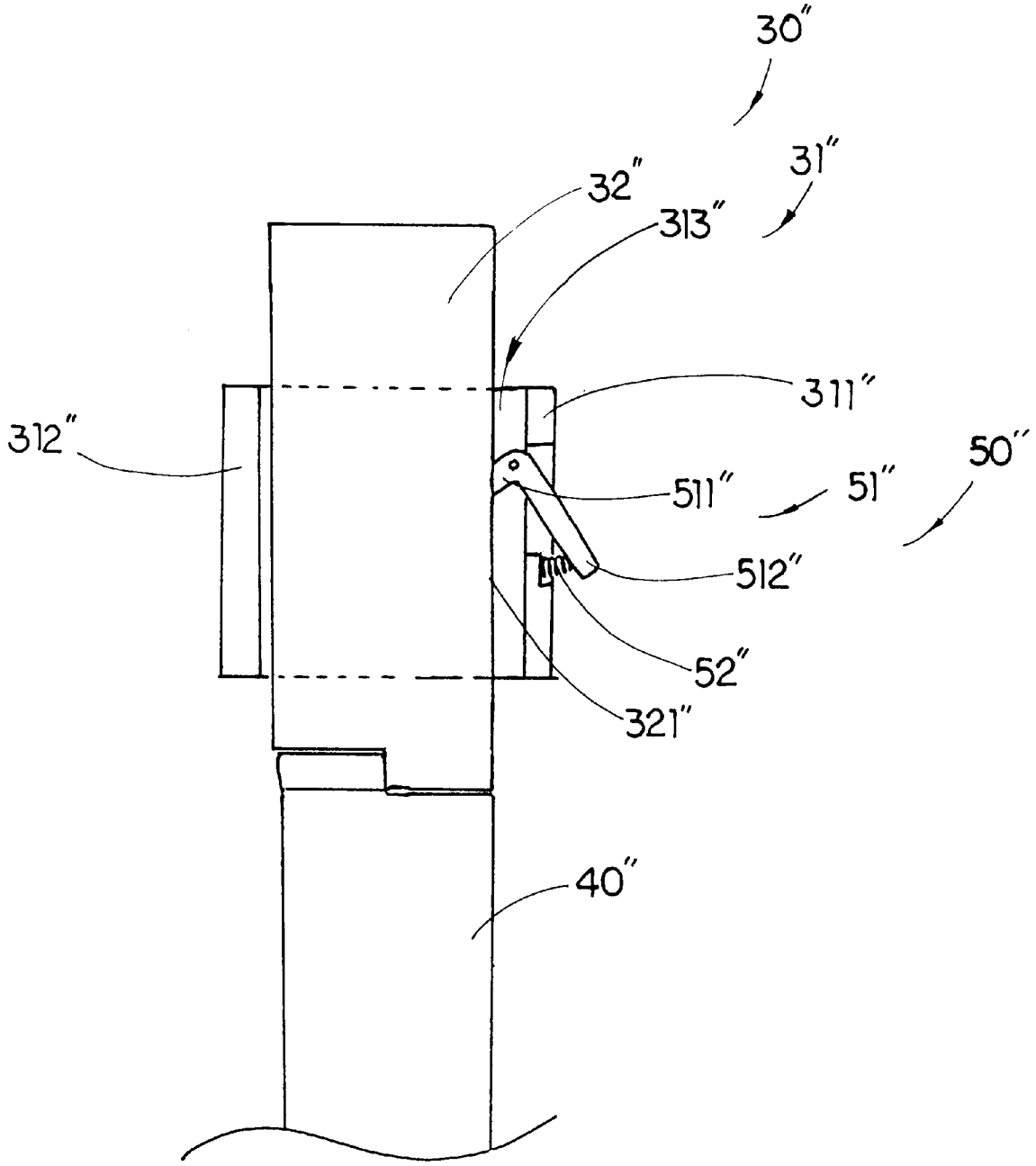
FIG. 7 is a sectional view of a holding means of the slide window and door lock according to the above third preferred embodiment of the present invention.

As shown in FIG. 7, the holding means 50" comprises a L-shaped pivot arm 51" pivotally supported in the guiding slot 313" wherein the pivot arm 51" has one engaging end 511" normally biasing against a side edge 321" of the driving panel 32" and another operation end 512" outwardly extended to an exterior of the connecting member 31" through one of the connecting walls 311", 312", and a resilient element 52" having two ends biasing against an inner surface of the operation end 512" of the pivot arm 51" and an outer surface of the respective connecting wall 311" for normally urging and retaining the engaging end 511" of the pivot end 51" to bias against the driving panel 32".

The operation end 512" of the pivot arm 51" is arranged to pivotally move the engaging end 51" away from the side edge 321" of the driving panel 32" when a inward pushing force is applied on the operation end 512" of the pivot arm 51" in such a manner that the locker panel 40" is adapted for being suspendedly held by the pivot arm 51".

What is claimed is:

1. A slide window and door lock for window/door assembly which comprises a sliding panel, having a vertical jamb, slidably mounted on a base slider track, wherein said slide window and door lock comprises:

a connecting device selectively mounted on said vertical jamb at a predetermined height with respect to said base slider track; and a locker panel having one pivot edge pivotally connecting to said connecting device and another opposed locking edge selectively moved between a locked position and an unlocked position, wherein in said locked position, said locking edge of said locker panel is inclinedly biased against said base slider track at a predetermined angle so as to lock up said sliding panel in a slidably movable manner and in said unlocked position, said locking edge of said locker panel is moved away from said base slider track such that said sliding panel is capably of freely sliding along said base slider track, wherein said locker panel further comprises at least a guiding groove longitudinally extended from said locking edge of said locker panel and adapted for fitting to a guide wall which is upwardly extended from said base slider track.

2. A slide window and door lock, as recited in claim 1, wherein said connecting device is adjustably mounted on said vertical jamb at said predetermined height with respect to said base slider track, which is less than a length of said locker panel in such a manner that said locker panel is adapted for inclinedly biasing against said base slider track at said locking edge in said locked position.

3. A slide window and door lock, as recited in claim 2, wherein said connecting device comprises a U-shaped connecting member comprising a first and second connecting walls extended integrally for receiving said vertical jamb therebetween, and an adjustable screw rotatably penetrated through said first connecting wall wherein a head portion of said adjustable screw is arranged to adjustably bias against said jamb of said sliding panel at a side thereof when said connecting member is mounted on said sliding panel, so as to securely mount said connecting device on said vertical jamb of said sliding panel.

4. A slide window and door lock, as recited in claim 1, wherein said connecting device comprises a connecting panel affixedly attached on said vertical jamb at a rear surface thereof wherein said pivot edge of said locker panel is pivotal connecting to said connecting panel edge to edge.

5. A slide window and door lock, as recited in claim 4, further comprising a at least a first holding member provided on a front surface of said connecting panel and at least a second holding member provided on a corresponding surface of said locker panel in such a manner that said locker panel is pivotally mounted on said connecting panel by detachably attaching said second holding member to said first holding member.

6. A slide window and door lock, as recited in claim 5, wherein said first holding member is a protrusion outwardly extended from said front surface of said connecting panel and said second holding member is a holding slot having a size and shape corresponding to said protrusion and adapted for said protrusion fittedly inserting into said holding slot, so as to hold said locker panel in said unlocked position.

7. A slide window and door lock, as recited in claim 1, wherein said connecting device comprises a connecting member having a U-shaped cross section comprising a pair of connecting walls wherein a guiding slot is defined between said two connecting walls, and a driving panel slidably mounted on said guiding slot in a vertical movable manner wherein said pivot edge of said locker panel is pivotally connected to said driving panel edge to edge and is arranged to be driven to slide on said guiding slot by said driving panel in a vertical movable manner.

8. A slide window and door lock, as recited in claim 7, wherein said driving panel has a width at least equal to a width of said locker panel in such a manner that said locker panel is adapted for fittedly sliding on said guiding slot of said connecting member.

9. A slide window and door lock, as recited in claim 8, further comprising a L-shaped pivot arm pivotally supported in said guiding slot wherein said pivot arm has one engaging end normally biasing against a side edge of said driving panel and another operation end outwardly extended to an exterior of said connecting member through one of said connecting walls, and a resilient element having two ends biasing against an inner surface of said operation end of said pivot arm and an outer surface of said respective connecting wall for normally urging and retaining said engaging end of said pivot end to bias against said driving panel.

10. A slide window and door lock, as recited in claim 7, further comprising a L-shaped pivot arm pivotally supported in said guiding slot wherein said pivot arm has one engaging end normally biasing against a side edge of said driving panel and another operation end outwardly extended to an exterior of said connecting member through one of said connecting walls, and a resilient element having two ends biasing against an inner surface of said operation end of said pivot arm and an outer surface of said respective connecting wall for normally urging and retaining said engaging end of said pivot end to bias against said driving panel.

11. A slide window and door lock, as recited in claim 1, wherein said connecting device comprises a U-shaped connecting member comprising a first and second connecting walls extended integrally for receiving said vertical jamb therebetween, and an adjustable screw rotatably penetrated through said first connecting wall wherein a head portion of said adjustable screw is arranged to adjustably bias against said jamb of said sliding panel at a side thereof when said connecting member is mounted on said sliding panel, so as to securely mount said connecting device on said vertical jamb of said sliding panel.

12. A slide window and door lock for window/door assembly which comprises a sliding panel, having a vertical jamb, slidably mounted on a base slider track, wherein said slide window and door lock comprises:

a connecting device, which is selectively mounted on said vertical jamb at a predetermined height with respect to said base-slider track, comprising a U-shaped connecting member comprising a first and second connecting walls extended integrally for receiving said vertical jamb therebetween, and an adjustable screw rotatably penetrated through said first connecting wall wherein a head portion of said adjustable screw is arranged to adjustably bias against said jamb of said sliding panel at a side thereof when said connecting member is mounted on said sliding panel, so as to securely mount said connecting device on said vertical jamb of said sliding panel; and a locker panel having one pivot edge pivotally connecting to said connecting device and another opposed locking edge selectively moved between a locked position and an unlocked position, wherein in said locked position, said locking edge of said locker panel is inclinedly biased against said base slider track at a predetermined angle so as to lock up said sliding panel in a slidably movable manner and in said unlocked position, said locking edge of said locker panel is moved away from said base slider track such that said sliding panel is capably of freely sliding along said base slider track.

13. A slide window and door lock for window/door assembly which comprises a sliding panel, having a vertical jamb, slidably mounted on a base slider track, wherein said slide window and door lock comprises:

a connecting device adjustably mounted on said vertical jamb at said predetermined height with respect to said base slider track, which is less than a length of said locker panel in such a manner that said locker panel is adapted for inclinedly biasing against said base slider track at said locking edge in said locked position, wherein said connecting device comprises a U-shaped connecting member comprising a first and second connecting walls extended integrally for receiving said vertical jamb therebetween, and an adjustable screw rotatably penetrated through said first connecting wall wherein a head portion of said adjustable screw is arranged to adjustably bias against said jamb of said sliding panel at a side thereof when said connecting member is mounted on said sliding panel, so as to securely mount said connecting device on said vertical jamb of said sliding panel; and a locker panel having one pivot edge pivotally connecting to said connecting device and another opposed locking edge selectively moved between a locked position and an unlocked position, wherein in said locked position, said locking edge of said locker panel is inclinedly biased against said base slider track at a predetermined angle so as to lock up said sliding panel in a slidably movable manner and in said unlocked position, said locking edge of said locker panel is moved away from said base slider track such that said sliding panel is capably of freely sliding along said base slider track.

14. A slide window and door lock for window/door assembly which comprises a sliding panel, having a vertical jamb, slidably mounted on a base slider track, wherein said slide window and door lock comprises:

a connecting device, which is selectively mounted on said vertical jamb at a predetermined height with respect to said base slider track, comprising a connecting panel affixedly attached on said vertical jamb at a rear surface thereof wherein said pivot edge of said locker panel is pivotal connecting to said connecting panel edge to edge;

a locker panel having one pivot edge pivotally connecting to said connecting device and another opposed locking edge selectively moved between a locked position and an unlocked position, wherein in said locked position, said locking edge of said locker panel is inclinedly biased against said base slider track at a predetermined angle so as to lock up said sliding panel in a slidably movable manner and in said unlocked position, said locking edge of said locker panel is moved away from said base slider track such that said sliding panel is capably of freely sliding along said base slider track; and at least a first holding member provided on a front surface of said connecting panel and at least a second holding member provided on a corresponding surface of said locker panel in such a manner that said locker panel is pivotally mounted on said connecting panel by detachably attaching said second holding member to said first holding member, wherein said first holding member is a protrusion outwardly extended from said front surface of said connecting panel and said second holding member is a holding slot having a size and shape corresponding to said protusion and adapted for said protrusion fittedly inserting into said holding slot, so as to hold said locker panel in said unlocked position.

15. A slide window and door lock for window/door assembly which comprises a sliding panel, having a vertical jamb, slidably mounted on a base slider track, wherein said slide window and door lock comprises:

a connecting device, which is selectively mounted on said vertical jamb at a predetermined height with respect to said base slider track, comprising a connecting member having a U-shaped cross section comprising a pair of connecting walls wherein a guiding slot is defined between said two connecting walls, and a driving panel slidably mounted on said guiding slot in a vertical movable manner wherein said pivot edge of said locker panel is pivotally connected to said driving panel edge to edge and is arranged to be driven to slide on said guiding slot by said driving panel in a vertical movable manner; and a locker panel having one pivot edge pivotally connecting to said connecting device and another opposed locking edge selectively moved between a locked position and an unlocked position, wherein in said locked position, said locking edge of said locker panel is inclinedly biased against said base slider track at a predetermined angle so as to lock up said sliding panel in a slidably movable manner and in said unlocked position, said locking edge of said locker panel is moved away from said base slider track such that said sliding panel is capably of freely sliding along said base slider track.

16. A slide window and door lock, as recited in claim 15, wherein said driving panel has a width at least equal to a width of said locker panel in such a manner that said locker panel is adapted for fittedly sliding on said guiding slot of said connecting member.

* * * * *